United States Patent [19]

Scott

[11] Patent Number: 4,532,679

[45] Date of Patent: Aug. 6, 1985

[54] CABLE TIE

[75] Inventor: William J. Scott, Sycamore, Ill.

[73] Assignee: Ideal Industries, Inc., Sycamore, Ill.

[21] Appl. No.: 567,813

[22] Filed: Jan. 3, 1984

[51] Int. Cl.[3] ..... B65D 63/00

[52] U.S. Cl. ..... 24/16 PB; 24/17 AP; 24/30.5 P

[58] Field of Search ..... 24/16 PB, 17 AP, 30.5 P, 24/20 TT; 248/74.3, 74.5

[56] References Cited

U.S. PATENT DOCUMENTS

| | | | |
|---|---|---|---|
| 3,717,906 | 2/1973 | Wells | 24/16 PB |
| 3,747,164 | 7/1973 | Fortsch | 24/16 PB |
| 3,872,547 | 3/1975 | Caveney et al. | 24/16 PB |
| 3,908,233 | 9/1975 | Caveney et al. | 24/16 PB |
| 3,973,292 | 8/1976 | Bonnet | 24/16 PB |
| 4,093,288 | 6/1978 | Suzuki | 24/16 PB |
| 4,137,606 | 2/1979 | Wood | 24/16 PB |
| 4,245,374 | 1/1981 | Suzuki | 24/16 PB |
| 4,473,524 | 9/1984 | Paradis | 24/16 PB |

FOREIGN PATENT DOCUMENTS

| | | | |
|---|---|---|---|
| 2528724 | 2/1976 | Fed. Rep. of Germany | 24/16 PB |

*Primary Examiner*—Victor N. Sakran

*Attorney, Agent, or Firm*—Kinzer Plyer, Dorn & McEachran

[57] ABSTRACT

This is a cable tie which has a head or frame at one end of the strap with the other end of the strap being constructed and arranged to be inserted through a transverse opening or channel in the head. The head has two opposed pawls which are spaced apart a distance somewhat less than the minimum strap distance with the pawls being differentially mounted or constructed so that the cable tie will stand up to or handle maximum stress conditions more efficiently.

8 Claims, 8 Drawing Figures

CABLE TIE

SUMMARY OF THE INVENTION

This is concerned with a cable tie and is more specifically concerned with a cable tie that uses two pawls in the frame at one end of the cable tie which are constructed to better handle maximum stress conditions i.e. greater load.

A primary object of the invention is a cable tie which has two pawls with differential flexibility or resistance so that the pawl on the strap side of the frame will be stiffer.

Another object is a double pawl cable tie in which the free side pawl has a reduced cross section hinge.

Another object is a cable tie of the above type in which the pawls have risers which, under maximum stress conditions, i.e. reverse pull-through of the pawls is prevented.

Another object is a cable tie of the above type that has differential entrance angles on the pawls which will result in the strap being biased against the strap side pawl.

Another object is a cable tie constructed and arranged to provide easy insertion of the strap.

Another object is a cable tie in which, under load, the strap deflects in cross section inside of the head.

Another object is a cable tie of the above type which has an extension for the hinge of the free side pawl.

Another object is a cable tie of the above type which has a greater flexibility ratio for the free side pawl.

Another object is a cable tie of the above type with two pawls in which the strap side pawl has a greater moment arm than the free side pawl.

Another object is a cable tie of the above type using two pawls that are structured and arranged so that under extreme loading the pawls will not collapse.

Other objects will appear from time to time in the ensuing specification and drawings.

BRIEF DESCRIPTION OF THE PREFERRED EMBODIMENT

Figure 1:
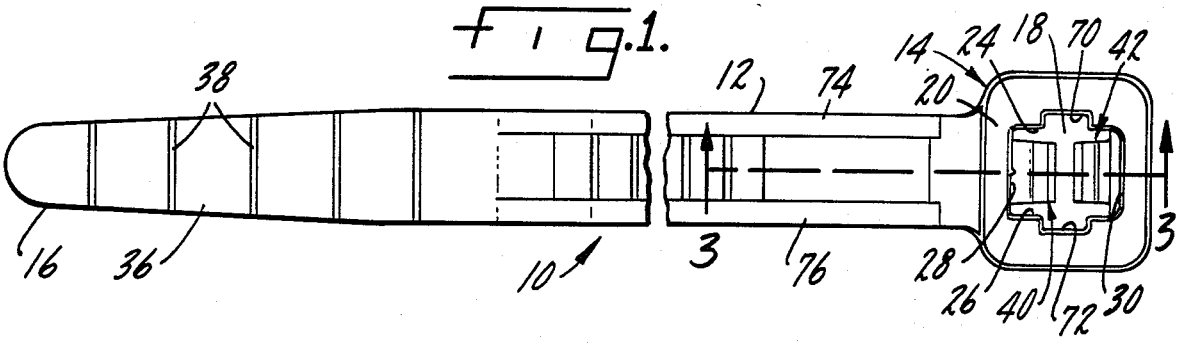
FIG. 1 is a plan view of the cable tie.
Figure 2:
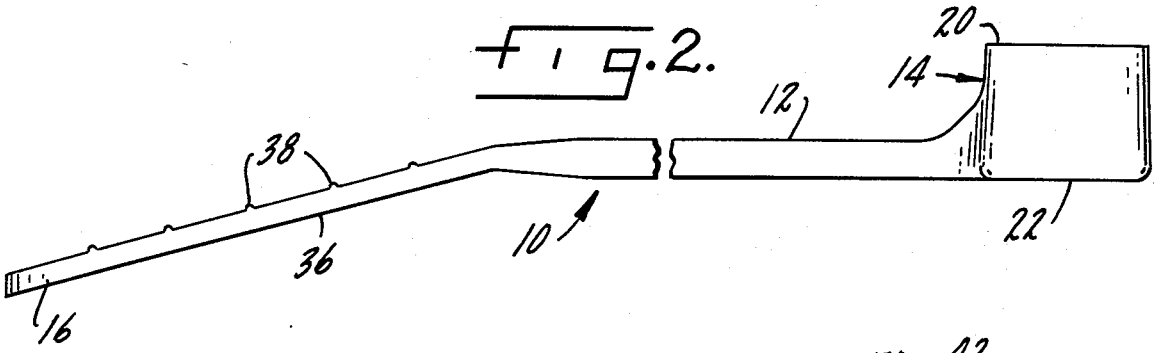
FIG. 2 is a side view of FIG. 1.

In FIG. 1 the cable tie is indicated generally at 10 and includes a strap 12 integrally joined or formed with a head or frame 14 at one end and a tail or free end 16 at the other. As shown in FIG. 2, the head or frame is coplanar with one side of the strap and projects beyond the other, which may be considered the top.

The frame has a passage or channel 18 through it with openings on each surface 20 and 22 which may be considered the top and bottom surfaces. The channel or passage is more or less square and is made up of two longitudinal or side walls 24 and 26 and two lateral or end walls, one 28 adjacent the strap side of the frame and the other 30 adjacent the free side of the frame.

Figure 3:
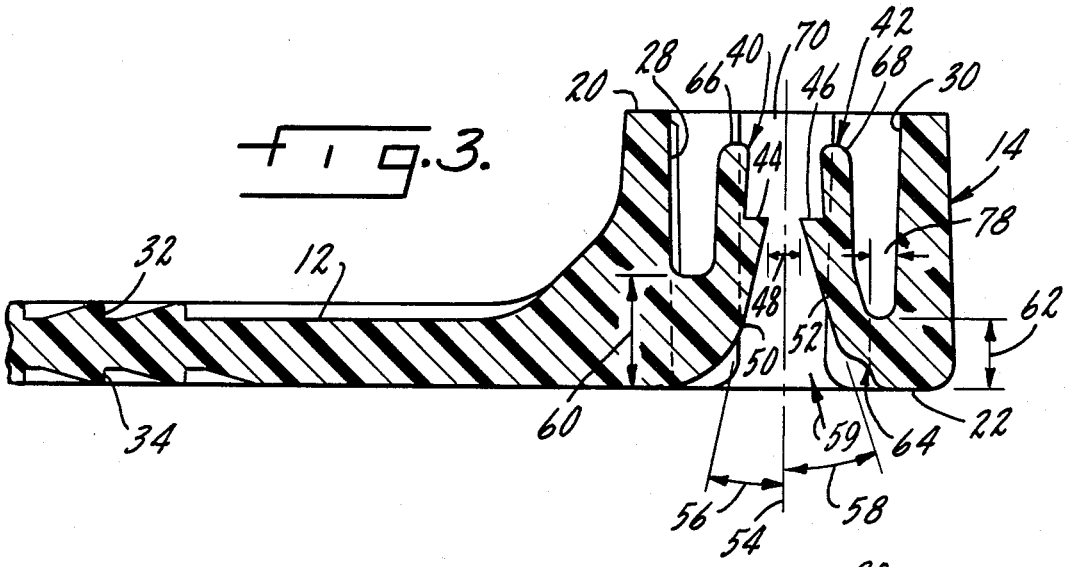
FIG. 3 is a section along line 3—3 of FIG. 1, on an enlarged scale.

The strap 12 has ratchet teeth 32 and 34 formed on each side thereof and, as shown, they are aligned laterally as shown in FIG. 3 although the ratchet teeth on one side might be staggered or offset relative to the ratchet teeth 34 on the other side. This is to say that those on one side could be positioned between or 90° offset or otherwise staggered from those on the other side in which case a modification of the head structure would be appropriate as explained hereinafter. If the ratchet teeth 32, 34 and the strap are staggered or displaced longitudinally from each other, the steps or shoulders 44, 46 on the pawl should be also staggered or out-of-line to the same degree. The strap has an outer end 36 which is the offset or extends downwardly as shown in FIG. 2 with gripping projections 38 on one or both sides disposed along it.

Two pawls 40 and 42 are formed inside of the channel in the head, the one 40 being on the strap side lateral wall and the other 42 on the free side lateral wall. The pawls are formed or hinged adjacent the lower surface 22 as shown in FIG. 3, and extend up toward the opening in the channel on the remote head surface 20 but, as shown in FIG. 3, do not rise or stick out of the top of the head. The pawls oppose each other and the strap is arranged to be reversely flexed and inserted through the head from the bottom in FIG. 3. The pawls have abutments or steps 44 and 46 which, in their free state, have a minimum spacing 48 which is somewhat less than the minimum strap thickness so that when the strap is inserted, the pawls will be flexed apart.

The pawls have inclined or dihedral entrance surfaces 50 and 52 which are formed at predetermined angles relative to the channel axis 54. For example the angle 58 of the free side pawl's entrance surface is on the order of 50% greater than the angle 56 of the strap side pawl's entrance surface. Representative examples are 12° for angle 56 and 18° for angle 58. But whatever angles are used, the result is that the entrance channel or funnel is such that insertion of the tail of the strap will be guided, in FIG. 3, from down-right to up-left because the resultant entrance channel moves up to the left in FIG. 3. This tends to guide the strap in the direction of arrow 59 in FIG. 3 which has been exaggerated for purposes of illustration for reasons explained hereinafter.

The strap side pawl 40 is joined to the frame for a substantial distance, as indicated at 60, from entrance surface 22 up, whereas the free side pawl 42 is only hinged for distance 62 which is substantially less than the hinged distance 60. The result is that the strap side pawl will be more substantially hinged to the frame than the free side pawl which results in the strap side pawl being stiffer. Stated the other way around, the free side pawl is more flexible. To regulate, adjust or determine the flexibility of the free side pawl 42, a portion of the base of its hinge may be removed, as at 64, so that the effective hinge, as shown by the dotted line, is less than the distance 62. The amount of effective hinge can be determined by how much material is omitted from the area 64 and the degree of flexibility of the free side hinge can be matched to the requirements of the cable tie depending upon its size, intended use, etc.

The pawls are provided with risers 66 and 68 which extend above the abutments or ledges 44, 46 a certain amount. Each of the risers may be rounded on top in that they do not necessarily function as an extra set of abutments or teeth but rather are to prevent the pawls from collapsing or being pulled back through the head under conditions of extreme or excessive loading. While they have been shown as rising the same amount, they may be different depending upon the performance desired during excessive loading conditions.

Figure 5:
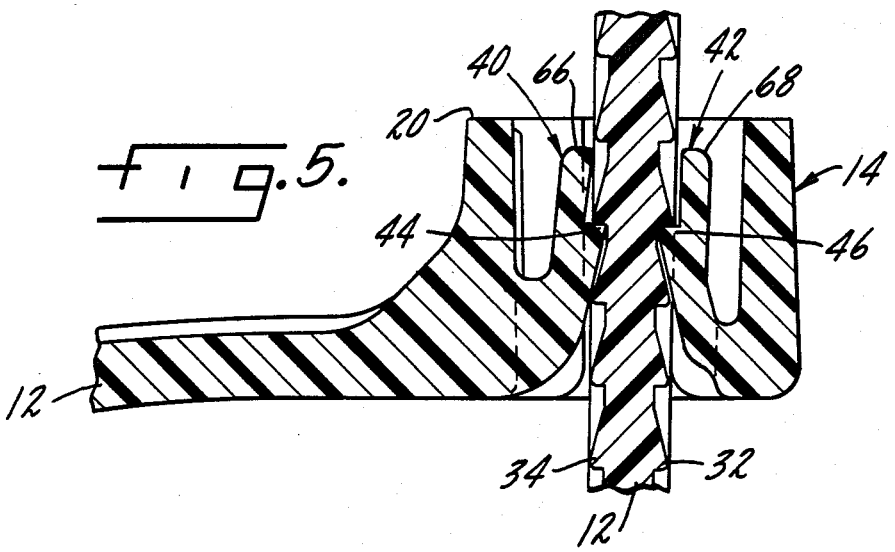
FIG. 5 is an operative position of the FIG. 3 form.
Figure 6:
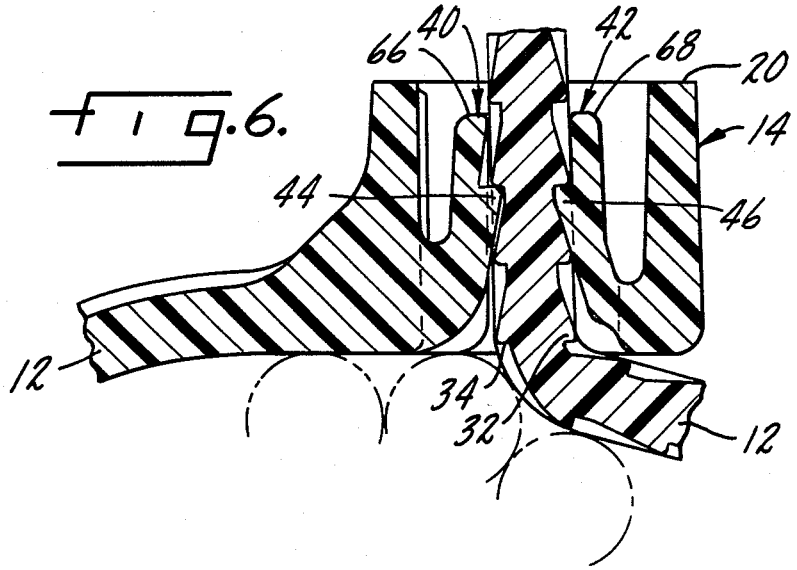
FIG. 6 is another operative position of the FIG. 3 form.

As shown in FIG. 5, when the strap has been inserted, the free side pawl 42 deflects more than the strap side pawl 40 due to its particular hinge construction. When the strap is pulled tight around a wire bundle, or whatever the application, such as shown in FIG. 6, either manually or by a tool, the strap will tend to retract through the head which causes the ratchet teeth 32 and 34 to engage and press down on the abutments 44, 46. This load will tend to pull the pawls back through the frame with a slight pivoting motion, the strap side pawl clockwise and the free side pawl counterclockwise. Under sufficient load, the extensions 66 and 68 will contact the opposed sides of the strap, as shown in FIG. 6 which will resist any further collapsing of the pawls. These extensions in combination with the stiff pawl on the strap side and the flexible pawl on the free side of the frame greatly increases the retractive resistence of the structure.

Figure 7:
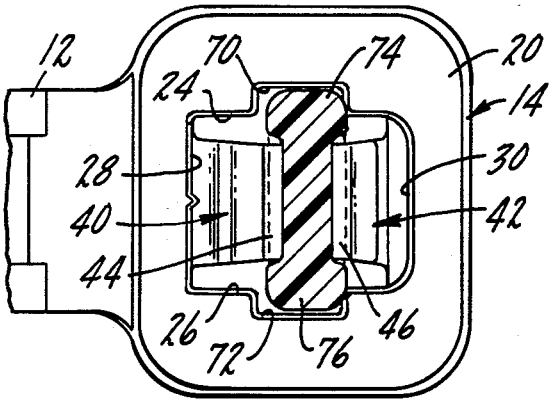
FIG. 7 is a top view of FIG. 5.
Figure 8:
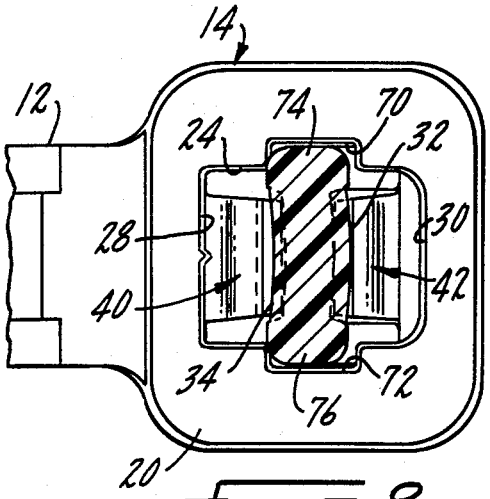
FIG. 8 is a top view of FIG. 6.

In addition each of the longitudinal walls of the channel in the head have grooves 70 and 72 therein which serve to guide or accept the peripheral edges of the strap, as shown in FIGS. 7 and 8. The ratchet teeth are countersunk in the general central plane of the strap so that enlargements 74 and 76 are provided on each edge which fit in the grooves 70, 72.

When the strap is under stress, for example as shown in FIG. 6, the rigid strap side pawl will deflect less than the flexible free side pawl with the result that the strap will be thrown against the free side of grooves 70 and 72. The bearing load resulting from the pawls through ledges or shoulders 44, 46 with pawl 40 being stronger or more resistent than pawl 42 will cause the strap to arch, in cross-section, due to the resilient thrust applied by the pawl. This slight arching can be seen in FIG. 8 although it may be somewhat exaggerated for purposes of illustration.

One of the advantages of the double pawl arrangement with one stiff pawl and the one limber pawl is that ease of insertion of the strap is acquired. If both pawls were stiff, or as stiff as the strap side pawl is, it would be difficult to insert the strap. But with the free side pawl being more flexibly hinged to the side wall and the stiffness of the hinge being easily determined or controlled, insertion of the strap can be made as easy as desired. At the same time strength is not lost and the retraction resisting ability of the strap may be set to whatever is desired by the stiffness of the strap side pawl as well as the projections 66, 68 above the abutments which engage the sides of the strap when excessive retractive force is applied. Since the weak pawl 42, if it may be referred to as such, probably deflects the most, the riser or abutment 68 thereon may well contact the side of the strap and resist further retraction of the strap before the riser 66 on the strong or stiff pawl contacts the strap. But they may be simultaneous. This is to say that the riser 68 on the weak pawl may be more important in certain applications.

Further, the weak pawl may be joined or hinged to the free side wall 30 by a sliver or extension, indicated at 78 in FIG. 3. This amounts to an extension of the base or hinge of the pawl which augments its resistivity to retraction of the strap without decreasing its flexibility and therefore does not interfere with strap insertion. The point is that the support of the pawl is stronger both vertically and horizontally without decreasing its flexibility which would interfere with strap insertion.

Figure 4:
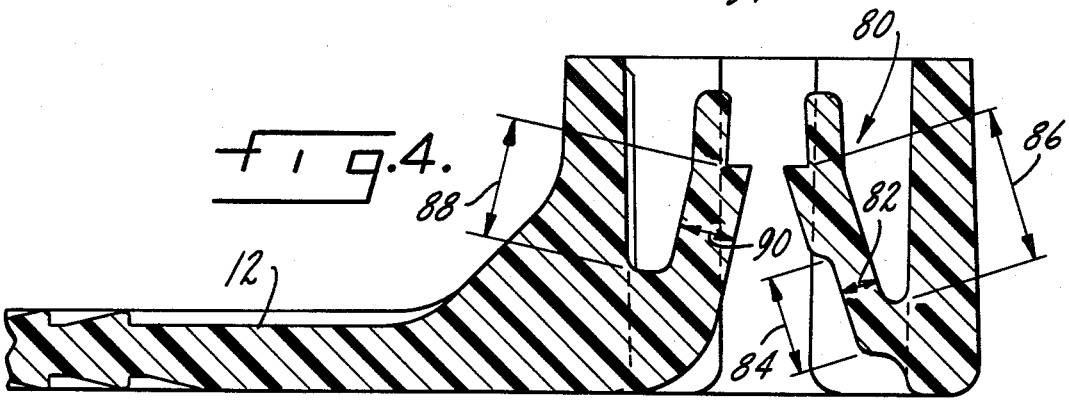
FIG. 4 is similar to FIG. 3 of a modified form.

In the FIG. 4 form, the so-called weak or free side pawl 80 has been thinned down toward the bottom, in the area marked 82 with the distance of the thinning down being designated 84. It will be understood that the thickness of the thinned down area 82 and the length 84 thereof may be varied depending upon the particular application. The result is that greater flexibility or a greater flexibility ratio may be acquired. For example, a desirable flexibility ratio, depending upon the size of the cable tie involved, could be something on the order of 8:1. In addition, the moment arm of the weak pawl may be considered to extend from the bottom up to the abutment ledge, as indicated at 86, with the corresponding moment arm 88 for the stiff pawl being shown thereon. The result is that the weak pawl will have a much greater moment arm than the stiff pawl which is of advantage in flexibility and ease of insertion without sacrificing retractive resistance. In addition the thickness of the weak pawl adjacent the hinge as at 82 is substantially less than the thickness of the stiff pawl as at 90. The result is a longer moment arm and a thinner section in the bending area for the weak pawl as compared to the stiff one without sacrificing any of the shear resistance of the weak pawl, the shear resistance being determined by the cross section at the hinge.

While the preferred form and several variations of the invention have been shown, described and suggested, it should be understood that suitable additional modifications, changes, substitutions and alterations may be made without departing from the invention's fundamental theme.

I claim:

1. An integral one piece cable tie to encircle and be tensioned about a bundle of wires or the like, comprising an elongated flexible strap, ratchet teeth formed on opposite sides of the strap, a frame at one end of the strap and integral therewith, the frame having a channel therethrough disposed on an axis generally at right angles to the free orientation of the strap and having openings on the end faces of the frame, a free end on the strap remote from the frame and constructed to be inserted and drawn through the channel in the frame when the strap is reversely flexed, the channel through the frame being defined at least in part by two longitduinally disposed side walls and two laterally disposed end walls positioned about the axis of the opening, a pair of laterally disposed opposed pawls in the opening integrally formed on the end walls thereof and terminating laterally in sapced relation to the side walls, the pawls being constructed and arranged to engage and interlock with the ratchet teeth on the strap when it is reversely flexed and inserted through the frame channel, each of the pawls being hinged to its end wall toward one of the end faces of the channel and extending axially somewhat toward the other end face, the free side pawl being more flexible than the strap side pawl, the pawls being formed with opposed abutments spaced apart from each other somewhat less than the minimum strap width the pawls including opposed risers above the abutments which contact the sides of the strap under substantial stress conditions to resist further withdrawal of the strap from the frame.

2. An integral one piece cable tie to encircle and be tensioned about a bunch of wires or the like, comprising an elongated flexible strap, ratchet teeth formed on opposite sides of the strap, a frame at one end of the strap and integral therewith, the frame having a channel therethrough disposed on an axis generally at right angles to the free orientation of the strap and having openings on the end faces of the frame, a free end on the strap remote from the frame and constructed to be inserted and drawn through the channel in the frame when the strap is reversely flexed, the channel through the frame being defined at least in part by two longitudinally disposed side walls and two laterally disposed end walls positioned about the axis of the opening, a pair of laterally disposed opposed pawls in the opening integrally formed on the end walls and terminating laterally in spaced relation to the side walls, the pawls being constructed and arranged to engage and interlock with the ratchet teeth on the strap when it is reversely flexed and inserted through the frame channel, each of the pawls being hinged to its end wall toward one of the end faces of the channel and extending axially somewhat toward the other end wall, opposed abutments toward the free ends of the pawls spaced from each other in their relaxed state by a distance somewhat less than the minimum strap thickness, and opposed risers above the abutments constructed and arranged to contact the sides of the strap under substantial stress conditions to further resist withdrawal of the strap from the frame.

3. The structure of claim 2 further characterized in that the pawl on the free side of the frame has more free length than the strap side pawl.

4. The structure of claim 2 characterized in that the pawl on the free side of the frame has a reduced cross section adjacent its hinge.

5. The structure of claim 2 characterized in that the pawl on the free side of the frame includes an offset so that its hinge is in spaced relation to the free side lateral end wall.

6. An integral one piece cable tie to encircle and be tensioned about a bundle of wires or the like, comprising an elongated flexible strap, ratchet teeth formed on opposite sides of the strap, a frame at one end of the strap and integral therewith, the frame having a channel therethrough disposed on an axis generally at right angles to the free orientation of the strap and having openings on the end faces of the frame, a free end on the strap remote from the frame and constructed to be inserted and drawn through the channel in the frame when the strap is reversely flexed, the channel through the frame being defined at least in part by two longitudinally disposed side walls and two laterally disposed end walls positioned about the axis of the opening, a pair of laterally disposed opposed pawls in the opening integrally formed on the end walls thereof and terminating laterally in spaced relation to the side walls, the pawls being constructed and arranged to engage and interlock with the ratchet teeth on the strap when it is reversely flexed and inserted through the frame channel, each of the pawls being hinged to its end wall toward one of the end faces of the channel and extending axially somewhat toward the other end face, the pawls being formed with opposed abutments that engage the ratchet teeth on the straps, and risers above the abutments that contact the sides of the strap under substantial stress conditions to resist further withdrawal of the strap from the frame.

7. The structure of claim 6 further characterized in that the hinge of the pawl on the strap side of the frame is more substantial than the hinge of the pawl on the free side so that the free side pawl is more flexible than the strap side Pawl.

8. An integral one piece cable tie to encircle and be tensioned about a bundle of wires or the like, comprising an elongated flexible strap, ratchet teeth formed on opposite sides of the strap, a frame at one end of the strap and integral therewith, the frame having a channel therethrough disposed on an axis generally at right angles to the free orientation of the strap and having openings on the end faces of the frame, a free end on the strap remote from the frame and constructed to be inserted and drawn through the channel in the frame when the strap is reversely flexed, the channel through the frame being defined at least in part by two longitudinally disposed side walls and two laterally disposed end walls positioned about the axis of the opening, a pair of laterally disposed opposed pawls in the opening integrally formed on the end walls thereof and terminating laterally in spaced relation to the side walls, the pawls being constructed and arranged to engage and interlock with the ratchet teeth on the strap when it is reversely flexed and inserted through the frame channel, each of the pawls being hinged to its end wall toward one of the end faces of the channel and extending axially somewhat toward the other end face, and an offset between the free side pawl and the free side lateral end wall so that its hinge is in spaced relation to its end wall the pawls being formed with opposed abutments that engage the ratchet teeth on the strap, and further including risers above the abutments constructed and arranged to contact the sides of the strap under conditions of substantial stress to resist further withdrawal of the strap from the frame.

* * * * *